US009062364B2

(12) United States Patent
Sano et al.

(10) Patent No.: US 9,062,364 B2
(45) **Date of Patent: *Jun. 23, 2015**

(54) METHOD FOR PRODUCING CARBONITRIDED MEMBER

(75) Inventors: Naoyuki Sano, Takarazuka (JP); Masayuki Horimoto, Nishinomiya (JP); Yoshinari Okada, Utsunomiya (JP); Masaki Amano, Utsunomiya (JP); Akihito Ninomiya, Utsunomiya (JP)

(73) Assignees: NIPPON STEEL & SUMITOMO METAL CORPORATION, Tokyo (JP); HONDA MOTOR CO., LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/415,198

(22) Filed: Mar. 8, 2012

(65) Prior Publication Data

US 2012/0211122 A1 Aug. 23, 2012

Related U.S. Application Data

(63) Continuation of application No. PCT/JP2010/065532, filed on Sep. 9, 2010.

(30) Foreign Application Priority Data

Sep. 11, 2009 (JP) ..... 2009-210019

(51) Int. Cl.

| | |
|---|---|
| ***C23C 8/32*** | (2006.01) |
| ***C23C 8/02*** | (2006.01) |
| ***C21D 1/25*** | (2006.01) |
| ***C21D 1/74*** | (2006.01) |
| ***C21D 7/06*** | (2006.01) |
| ***C21D 9/32*** | (2006.01) |
| ***C22C 38/02*** | (2006.01) |
| ***C22C 38/04*** | (2006.01) |
| ***C22C 38/18*** | (2006.01) |
| ***C23C 8/22*** | (2006.01) |
| *C23C 8/80* | (2006.01) |

(52) U.S. Cl.

CPC ... *C23C 8/02* (2013.01); *C21D 1/25* (2013.01); *C21D 1/74* (2013.01); *C21D 7/06* (2013.01); *C21D 9/32* (2013.01); *C22C 38/02* (2013.01); *C22C 38/04* (2013.01); *C22C 38/18* (2013.01); *C23C 8/22* (2013.01); *C23C 8/32* (2013.01); *C23C 8/80* (2013.01)

(58) Field of Classification Search

CPC ..... C23C 8/02; C23C 8/22; C23C 8/32; C21D 1/06

USPC ..... 148/218, 219

See application file for complete search history.

(56) References Cited

U.S. PATENT DOCUMENTS 6,544,360 B1 * 4/2003 Tange et al. ..... 148/580

FOREIGN PATENT DOCUMENTS

| | | |
|---|---|---|
| CN | 1209466 | 3/1999 |
| CN | 1354802 | 6/2002 |

(Continued)

OTHER PUBLICATIONS

Shigeo Owaku, Jis Tekko Zairyo Nyumon, 3rd edition, 3rd print, Minoru Kanai , Feb. 10, 1997, p. 56.

*Primary Examiner* — Kaj K Olsen

*Assistant Examiner* — Alexander Polyansky

(74) *Attorney, Agent, or Firm* — Clark & Brody

(57) ABSTRACT

A method for producing a carbonitrided member comprising the steps of carburizing a steel part having a composition of, by mass percent, C: 0.10 to 0.35%, Si: 0.15 to 1.0%, Mn: 0.30 to 1.0%, Cr: 0.40 to 2.0%, S: 0.05% or less with the balance being Fe and impurities in a carburizing atmosphere of 900 to 950° C. The carburized steel part is carbonitrided in a carbonitriding atmosphere with the temperature of 800 to 900° C. and the nitrogen potential of 0.2 to 0.6%. The carbonitrided steel part is qhenched and then shot peened. The shot peening treatment may be further performed while heating to a temperature not higher than 350° C. or immediately after heating to a temperature not higher than 350° C. After quenching, the shot peening treatment may be further performed after tempering in the temperature range exceeding 250° C. and not higher than 350° C.

4 Claims, 3 Drawing Sheets

(56) References Cited

FOREIGN PATENT DOCUMENTS

| | | | | | |
|---|---|---|---|---|---|
| JP | 05-255731 | | | 10/1993 | |
| JP | 05255731 | A | * | 10/1993 | ..... C21D 6/00 |
| JP | 07-190173 | | | 7/1995 | |
| JP | 07190173 | A | * | 7/1995 | ..... F16H 55/06 |
| JP | 11-051155 | | | 2/1999 | |
| JP | 2001-140020 | | | 5/2001 | |
| JP | 2002-194492 | | | 7/2002 | |
| JP | 2006-281343 | | | 10/2006 | |

* cited by examiner

METHOD FOR PRODUCING CARBONITRIDED MEMBER

This application is a continuation of the international application PCT/JP2010/065532 filed on Sep. 9, 2010, the entire content of which is herein incorporated by reference.

TECHNICAL FIELD

The present invention relates to a method for producing a member subjected to carbonitriding treatment (hereinafter, referred to as a "carbonitrided member"). More particularly, it relates to a method for producing a carbonitrided member that is suitable as a power transmitting part and is excellent in wear resistance, critical strength against pitting, and bending fatigue strength.

BACKGROUND ART

Power transmitting parts such as gears that are used for automotive transmissions and pulleys for belt-type continuously variable transmissions (CVTs) have conventionally been produced as described below. A steel material of low-alloyed steel for machine structural use specified in JIS G4053 (2008) is formed into a predetermined shape by forging, cutting or the like, is subjected to surface hardening treatment such as carburizing-quenching or carbonitriding-quenching, and thereafter is further tempered.

In recent years, a demand for improved fuel economy of motor vehicles has become more stringent. Accordingly, in order to realize a reduction in weight of vehicle body which directly leads to the improvement in fuel economy, further reduction in size and further increase in strength are also demanded for the parts, and much importance has been attached to the improvement in critical strength against pitting, which is one kind of rolling contact fatigue behaviors, (hereinafter, referred to as "pitting strength") and wear resistance.

The steel material of low-alloyed steel for machine structural use that contains about 0.2 mass % of carbon and is used as a starting material for carburized parts and carbonitrided parts comes in a manganese based steel represented by SMn420, a manganese-chromium based steel represented by SMnC420, a chromium based steel represented by SCr420, and a chromium-molybdenum based steel represented by SCM420. The recent increase in prices of rare metal elements has been remarkable, and in particular, the price of molybdenum has increased sharply.

"Carbonitriding" includes "gas carbonitriding" in which ammonia gas is mixed in a carburizing atmosphere, whereby nitriding is performed simultaneously with carburizing, and it is said that nitrogen has an effect of increasing a resistance to softening during tempering. However, carbonitriding poses a problem of decreased hardening depth because nitrogen has a suppressive action on the diffusion of carbon, and in addition, nitriding treatment is performed at a lower temperature than carbonizing treatment. Further, because nitrogen is an austenite stabilizing element, and also lowers the Ms temperature in the same way as carbon, carbonitriding has a tendency to form substantial amount of retained austenite, which makes it difficult to obtain hard martensite.

Accordingly, the techniques for solving the problems with carbonitriding have been disclosed as "Gear having excellent tooth contact strength and manufacture thereof", "High strength gear", "Method for heat-treating carbo-nitriding treated member excellent in pitting resistance", and "High hardness parts" in Patent Documents 1 to 4, respectively.

LIST OF PRIOR ART DOCUMENTS

Patent Document

Patent Document 1: JP11-51155A
Patent Document 2: JP7-190173A
Patent Document 3: JP2001-140020A
Patent Document 4: JP2002-194492A

DISCLOSURE OF THE INVENTION

Problems to be Solved by the Invention

In the gear manufacturing method disclosed in Patent Document 1, it is necessary to perform reheating-quenching to increase the nitrogen invasion depth and to increase the effective hardening depth. Therefore, this method is not efficient from the standpoint of manufacturing process and energy consumption.

The high strength gear disclosed in Patent Document 2 provides a technique in which the amount of retained austenite is merely restricted to 10 to 40% to provide a dominant microstructure of fine martensite containing nitrogen or fine martensite containing nitrogen and lower bainite. Therefore, sufficient wear resistance and pitting strength cannot necessarily be achieved.

The heat-treating method disclosed in Patent Document 3 is based on a technical concept that by performing tempering at a temperature of 200 to 560° C. that is higher than the conventional temperature of 150 to 180° C., soft retained austenite is decomposed into martensite and η carbides, thereby increasing the surface hardness, and nitrides such as CrN and AlN finely precipitate resulting in precipitation hardening, thereby improving the pitting resistance. However, although when tempering is performed in the temperature range of 200 to 560° C., the control of nitrogen concentration in the retained austenite is important in order to decompose the retained austenite into a mixed structure of martensite and η carbides that can increase the surface hardness, what degree of amount of nitrogen should be introduced in the carbonitriding process (that is, the optimum nitrogen potential) has not been disclosed at all. Therefore, in some cases, the mixed structure cannot be obtained at all depending on the choice of the nitrogen potential. In addition, if tempering is performed at a higher temperature in the specified temperature range to the extent that even the precipitation of alloying element nitrides such as CrN and AlN occurs, the retained austenite is decomposed into ferrite and cementite, not into martensite and η carbides, or a coarse $\gamma'$-$Fe_4N$ nitride precipitates are also formed, so that there arises a problem that the hardness decreases significantly, and the pitting strength rather decreases.

The steel for carbonitriding that is applied to the high hardness parts disclosed in Patent Document 4 is based on the technical concept that the resistance to softening during tempering is increased by the increase in the content of silicon. However, in the case where ordinary gas carbonitriding is merely applied without the control of a carbonitriding atmosphere, the acceleration of grain boundary oxidation cannot be avoided because of the high silicon content, which poses a problem that a sufficient surface hardness cannot be obtained.

As described above, the carbonitriding techniques having been proposed so far are insufficient to efficiently provide a carbonitrided member excellent in both of wear resistance and pitting strength. Further, the carbonitriding techniques have a problem that sufficient bending fatigue strength cannot be secured.

The present invention has been made in view of the present situation, and accordingly an objective thereof is to provide a method for producing a carbonitrided member having excellent wear resistance, high pitting strength, and excellent bending fatigue strength although the content of molybdenum, which is an expensive alloying element, is reduced or molybdenum is not added.

Means for Solving the Problems

The present inventor conducted carbonitriding experiments under various conditions by using case hardening steels of chromium base represented by SCr420 and chromium-molybdenum base represented by SCM420 to examine the relationship between the wear resistance and pitting strength of a carbonitrided member and the microstructure of a case-hardened layer. As the result, the present inventor obtained findings concerning a microstructure capable of achieving excellent wear resistance and high pitting strength due to carbonitriding, and previously proposed "Carbonitrided member and method for producing the same" filed by Japanese Patent Application No. 2008-307250 based on the findings.

Then, the present inventor earnestly carried out studies on a microstructure having not only excellent wear resistance and high pitting strength but also excellent bending fatigue strength due to carbonitriding, and resultantly obtained findings of items (a) to (c) described below.

(a) When the retained austenite produced in a hardened layer by quenching after carbonitriding is tempered in the temperature range exceeding 250° C. and not higher than 350° C., isothermal bainitic transformation occurs, and the retained austenite is decomposed into fine bainitic ferrite with a width of about 50 to 200 nm and a length of about 200 nm to 1 μm, $Fe_3C$ and $\alpha''$-$Fe_{16}N_2$. However, in the case where the holding time at the tempering temperature is short, not a small amount of retained austenite remains undecomposed, which brings about the decreases in pitting strength and bending fatigue strength.

(b) When the steel material in the state in which the progress of isothermal bainitic transformation is insufficient, and retained austenite remains undecomposed, is subjected to shot peening, the retained austenite transforms into deformation-induced martensite, and in this state, the pitting strength and bending fatigue strength are improved.

(c) When the isothermal bainitic transformation is accomplished while the retained austenite is subjected to shot peening, the hardness of a surface layer increases remarkably as compared with the case where the isothermal bainitic transformation is accomplished without shot peening. As a result, the pitting strength and bending fatigue strength are improved greatly.

The present invention has been completed on the basis of the above described findings, and involves a method for producing a carbonitrided member described in items (1) to (4).

(1) A method for producing a carbonitrided member comprising the steps of:

carburizing a steel part having a composition of, by mass percent, C: 0.10 to 0.35%, Si: 0.15 to 1.0%, Mn: 0.30 to 1.0%, Cr: 0.40 to 2.0%, S: 0.05% or less with the balance being Fe and impurities in a carburizing atmosphere of 900 to 950° C.;

carbonitriding the carburized steel part in a carbonitriding atmosphere with the temperature of 800 to 900° C. and the nitrogen potential of 0.2 to 0.6%;

quenching the carbonitrided steel part; and shot peening the quenched steel part.

(2) A method for producing a carbonitrided member comprising the steps of:

carburizing a steel part having a composition of, by mass percent, C: 0.10 to 0.35%, Si: 0.15 to 1.0%, Mn: 0.30 to 1.0%, Cr: 0.40 to 2.0%, S: 0.05% or less with the balance being Fe and impurities in a carburizing atmosphere of 900 to 950° C.;

carbonitriding the carburized steel part in a carbonitriding atmosphere with the temperature of 800 to 900° C. and the nitrogen potential of 0.2 to 0.6%;

quenching the carbonitrided steel part; and shot peening the quenched steel part while heating to a temperature not higher than 350° C. or immediately after heating to a temperature not higher than 350° C.

(3) A method for producing a carbonitrided member comprising the steps of:

carburizing a steel part having a composition of, by mass percent, C: 0.10 to 0.35%, Si: 0.15 to 1.0%, Mn: 0.30 to 1.0%, Cr: 0.40 to 2.0%, S: 0.05% or less with the balance being Fe and impurities in a carburizing atmosphere of 900 to 950° C.;

carbonitriding the carburized steel part in a carbonitriding atmosphere with the temperature of 800 to 900° C. and the nitrogen potential of 0.2 to 0.6%;

quenching the carbonitrided steel part; and shot peening the quenched steel part after tempering in the temperature range exceeding 250° C. and not higher than 350° C.

(4) The method for producing a carbonitrided member according to (1) to (3), wherein the composition of the steel part further contains Mo: 0.50% or less by mass percent in lieu of a part of Fe.

The phrase "immediately after heating to a temperature not higher than 350° C." in item (2) indicates "at a temperature T° C. after heating to the temperature T° C. not higher than 350° C." and "immediately after taking out of a heating furnace after having been heating to a temperature T° C. not higher than 350° C".

Advantageous Effects of the Invention

According to the method for producing a carbonitrided member in accordance with the present invention, although the starting material is an inexpensive steel in which the content of molybdenum, which is an expensive alloying element, is low or molybdenum is not added, there can be provided a carbonitrided member having excellent wear resistance, high pitting strength, and excellent bending fatigue strength. Therefore, the carbonitrided member produced by the method for producing a carbonitrided member in accordance with the present invention can be used as a power transmitting part such as a gear for an automotive transmission and a pulley for a belt-type continuously variable transmission, which is required to have a smaller size and higher strength to realize a reduction in weight of vehicle body which directly leads to the improvement in fuel economy. Further, the carbonitrided member can also realize a reduction in manufacturing cost as compared with the conventional power transmitting part.

BRIEF DESCRIPTION OF THE DRAWINGS

In FIG. 1, the "heating" step is illustrated by a "tempering" step, and the cooling at the time of "tempering" is described as "allowed to cool in the air".

MODE FOR CARRYING OUT THE INVENTION

Figure 1:
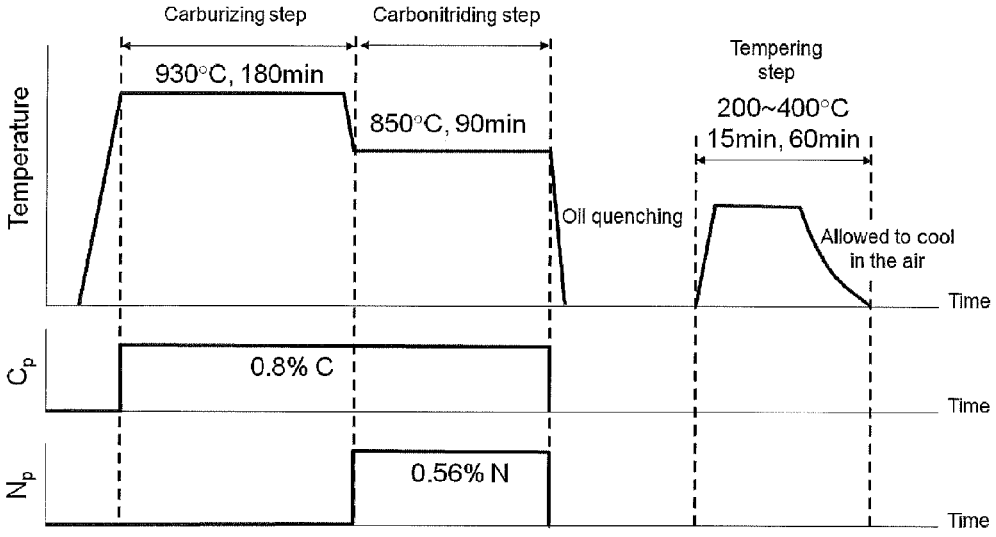
FIG. 1 is a schematic diagram demonstrating the conditions of a "carburizing" step, a "carbonitriding" step, a "quenching" step after carbonitriding, and a "heating" step after quenching, which are performed in examples. "Cp" and "Np" in FIG. 1 indicate a carbon potential and a nitrogen potential, respectively.

Hereunder, the requirements of the present invention are explained in detail.

(A) Chemical composition of raw steel material:

An ideogram of "%" of the content of each element described below means "mass percent".

C: 0.10 to 0.35%

Carbon (C) is the most important element for determining the strength of steel material. To ensure the strength of raw steel material, that is, the strength of a core that is not hardened by quenching after carbonitriding treatment, 0.10% or more of C must be contained. On the other hand, if the C content exceeds 0.35%, the toughness of the core degrades, or the machinability deteriorates. Therefore, the C content is from 0.10 to 0.35%. The C content is preferably 0.20% or more and 0.30% or less.

Si: 0.15 to 1.0%

Silicon (Si) is an element that has an inhibitory effect on the precipitation of cementite to enhance the resistance to softening during tempering, and also contributes to the increase in strength of core as a solid-solution strengthening element. Silicon also has a suppressive action on transformation of austenite into pearlite. These effects are achieved when the Si content is 0.15% or more. However, the increase in Si content results in a decrease in carburizing rate and a ductility loss. In particular, if the Si content exceeds 1.0%, the carburizing rate decreases remarkably, and additionally the hot workability deteriorates remarkably. Therefore, the Si content is from 0.15 to 1.0%. The Si content is preferably 0.20% or more and 0.90% or less.

Mn: 0.30 to 1.0%

Manganese (Mn) is an austenite stabilizing element, and reduces the activity of C in austenite to accelerate carburizing. Manganese also has an effect to form MnS with S to enhance the machinability. To achieve these effects, the Mn content must be 0.30% or more. However, even if Mn is contained exceeding 1.0%, the effects saturate and the cost increases. In some cases, even the machinability may deteriorate. Therefore, the Mn content is from 0.30 to 1.0%. The Mn content is preferably 0.50% or more and 0.90% or less.

Cr: 0.40 to 2.0%

Chromium (Cr) is an element that has a high affinity to carbon and nitrogen, and an effect to accelerate carbonitriding by reducing the activity of C and N in austenite during carbonitriding. Chromium also has an effect of increasing the strength of the core, which is not hardened by quenching after carbonitriding, due to the action of solid-solution strengthening. These effects are achieved when the Cr content is 0.40% or more. However, the increase in Cr content causes that Cr carbides and/or Cr nitrides precipitate at the grain boundary, so that Cr in the vicinity of the grain boundary becomes deficient. As a result, a defective layer caused by incomplete quenching and/or grain boundary oxidation is liable to be produced in the surface region of the member, and thereby the pitting strength and wear resistance are deteriorated. In particular, if the Cr content exceeds 2.0%, by the production of the defective layer caused by incomplete quenching and/or grain boundary oxidation in the surface region of the member, the pitting strength and wear resistance are deteriorated remarkably. Therefore, the Cr content is from 0.40 to 2.0%. The Cr content is preferably 0.50% or more and 1.80% or less.

S: 0.05% or less

Sulfur (S) is an element contained as an impurity. Also, S is an element that forms MnS with Mn to enhance the machinability. To achieve this effect, the S content is preferably 0.01% or more. On the other hand, if the S content becomes excessive and especially exceeds 0.05%, the hot ductility deteriorates, and cracking is liable to occur during forging. Therefore, the S content is 0.05% or less. The S content is preferably 0.03% or less.

One of the raw steel materials of the present invention contains Fe and impurities as the balance in addition to the elements.

The "impurities" referred to herein are elements that enter from the ore and scrap used as raw materials, the environment, and the like when the steel material is manufactured industrially.

Another of the raw steel materials of the present invention further contains Mo in an amount described below in addition to the elements.

Mo: 0.50% or less

Molybdenum (Mo) is an element that has effects of retarding the defective layer caused by incomplete quenching and/or grain boundary oxidation from being produced in the surface region of the member, and increasing the hardness of the core. Molybdenum may be contained to achieve these effects. However, if the Mo content exceeds 0.50%, not only the starting material cost increases, but also the machinability deteriorates remarkably. Therefore, if Mo is contained, the Mo content is 0.50% or less. The content of Mo if contained is preferably 0.30% or less.

To surely achieve the effects of retarding the defective layer caused by incomplete quenching and/or grain boundary oxidation from being produced in the surface region of the member, and increasing the hardness of the core, which Mo has, the content of Mo if contained is preferably 0.05% or more, further preferably 0.10% or more.

The raw steel material of the present invention contains P as an impurity, and P may be contained as far as the P content is 0.05% or less. The amount of P contained as an impurity is preferably 0.03% or less.

(B) Producing conditions:

The producing conditions of the present invention consist of any of processes of items (i) to (iii) described below.

(i) A process including:

a "carburizing" step in which a member is held in a carburizing atmosphere of 900 to 950° C., a "carbonitriding" step in which, following the carburizing step, the member is held in an atmosphere in which the temperature is decreased to 800 to 900° C., a nitriding atmosphere is additionally provided by mixing ammonia gas or the like while the carburizing atmosphere is maintained, and the nitrogen potential of 0.2 to 0.6%, a "quenching" step after carbonitriding, and a step of performing shot peening treatment.

(ii) A process including:

a "carburizing" step in which a member is held in a carburizing atmosphere of 900 to 950° C., a "carbonitriding" step in which, following the carburizing step, the member is held in an atmosphere in which the temperature is decreased to 800 to 900° C., a nitriding atmosphere is additionally provided while the carburizing atmosphere is maintained, and the nitrogen potential of 0.2 to 0.6%, a "quenching" step after carbonitriding, and a step of performing shot peening treatment while heating to a temperature not higher than 350° C. or immediately after heating to a temperature not higher than 350° C.

(iii) A process including:

a "carburizing" step in which a member is held in a carburizing atmosphere of 900 to 950° C., a "carbonitriding" step in which, following the carburizing step, the member is held in an atmosphere in which the temperature is decreased to 800 to 900° C., a nitriding atmosphere is additionally provided while the carburizing atmosphere is maintained, and the nitrogen potential of 0.2 to 0.6%, a "quenching" step after carbonitriding, a "tempering" step carried out in the temperature range exceeding 250° C. and not higher than 350° C., and a step of performing shot peening treatment.

The carburizing capability and nitriding capability of atmosphere are defined as a carbon potential and a nitrogen potential, respectively, and are represented by a carbon concentration and a nitrogen concentration, respectively, on the surface of a treated member when in equilibrium with the treatment atmosphere at the treatment temperature. Along with the treatment temperature and treatment time, a carbon concentration profile and a nitrogen concentration profile in the depth direction from the surface of treated member are determined. In the present invention, however, the nitrogen potential during treatment is estimated by analyzing a nitrogen concentration in the surface layer of the member after treatment. Therefore, the average concentration of nitrogen from the outermost surface of treated member to a position of 50 μm in depth when in equilibrium with the treatment atmosphere at the treatment temperature is referred to as a "nitrogen potential".

FIG. 1 schematically shows the conditions used in examples of the present invention as one example of the "carburizing" step, the "carbonitriding" step, the "quenching" step after carbonitriding, and "heating" step after quenching. "Cp" and "Np" in FIG. 1 indicate the carbon potential and the nitrogen potential, respectively. In FIG. 1 of this example, the "quenching" step is illustrated as "oil quenching", the "heating" step as "tempering" step, and the cooling at the time of tempering as "allowed to cool in the air".

Unlike FIG. 1, the carbon potential need not necessarily be kept in a fixed state in both steps of carburizing and carbonitriding. The carbon potential may be changed as appropriate from the viewpoints of target surface carbon concentration, effective hardened layer depth, and efficient operation.

The total treatment time of carburizing and carbonitriding can be shortened, for example, by setting the carbon potential in the carburizing step so as to be slightly higher than the target surface carbon concentration of the carbonitrided member, and by reducing the carbon potential to the target surface carbon concentration when the process proceeds to the next carbonitriding step.

In the "carburizing" step, there can be applied "gas carburizing" in which an endothermic gas, which is a mixed gas of CO, $H_2$ and $N_2$ (this gas is usually referred to as an "RX gas") obtained by converting a mixed gas of hydrocarbon gas such as butane or propane with air, is added together with a gas called an "enriched gas" such as butane or propane to perform carburizing. The treatment temperature in this "carburizing" step, that is, the holding temperature in the carburizing atmosphere is 900 to 950° C. If the temperature exceeds 950° C., grain coarsening is liable to occur, which easily leads to a decrease in strength after quenching If the temperature is lower than 900° C., it is difficult to obtain a sufficient hardened layer depth. The time period for which the member is held at the temperature depends on the magnitude of desired hardened layer depth, and about 2 to 15 hours is preferable. The carbon potential can be controlled exclusively by the added amount of enriched gas.

The "carbonitriding" step following the "carburizing" step is carried out in a carbonitriding atmosphere with the temperature of 800 to 900° C. and the nitrogen potential of 0.2 to 0.6%.

By performing carbonitriding at a temperature of 800 to 900° C. that is about 50° C. higher than the temperature in the conventional and general "carbonitriding" step, at which the solubility of nitrogen in austenite decreases, with the nitrogen potential being 0.2% or more, $\epsilon$-$Fe_3N$ and/or $\zeta$-$Fe_2N$, which are iron nitride particles with a major axis length of several tens nm to several hundreds nm, especially 50 to 300 nm, can be precipitated and dispersed. By performing carbonitriding with the nitrogen potential being 0.2% or more, austenite is stabilized, and retained austenite is liable to be produced. If the nitrogen potential is less than 0.2%, not only both of $\epsilon$-$Fe_3N$ and $\zeta$-$Fe_2N$, which are iron nitride particles with a major axis length of several tens nm to several hundreds nm, especially 50 to 300 nm, cannot be precipitated and dispersed, but also an incomplete quenching structure other than retained austenite and martensite may be produced. If the nitrogen potential exceeds 0.6%, the iron nitride particles are easily coarsened, and the major axis length exceeds 300 nm. And hence, the dispersion strengthening using the iron nitride particles is not attained.

The "carbonitriding" step has only to be performed by, for example, decreasing the in-furnace temperature to a temperature of 800 to 900° C., which is a temperature for carbonitriding, while the gas atmosphere in the carburizing step is maintained, and thereafter by adding ammonia gas. The nitrogen potential at this time can be controlled by the added amount of ammonia gas. The time period for which the member is held in the carbonitriding atmosphere has only to be several hours, for example, 1 to 2 hours.

The "quenching" step after carbonitriding has only to be carried out as the "oil quenching" step illustrated in FIG. 1.

In the carbonitriding step, nitrogen dissolves in austenite, and thereby austenite is stabilized. Therefore, even if the member is cooled rapidly by oil quenching, austenite that does not transform into martensite, that is, retained austenite is produced easily. The retained austenite decreases the surface layer hardness of the carbonitrided member, so that the pitting strength decreases.

To overcome this problem, conventionally, the retained austenite formation has been avoided by changing the conditions of oil quenching, or the produced retained austenite has been transformed into martensite by performing sub-zero treatment after oil quenching Then, after quenching, tempering has been performed at a low temperature of about 150 to 180° C.

However, the retained austenite produced in the case where quenching is performed after carbonitriding under the conditions described as processes (i) to (iii) is transformed into deformation-induced martensite by performing any of the treatments described below after quenching, and thereby the hardness is increased.

After the quenching, shot peening treatment is further performed.

After the quenching, shot peening treatment is further performed while heating to a temperature not higher than 350° C. or immediately after heating to a temperature not higher than 350° C.

After the quenching, shot peening treatment is further performed after tempering in the temperature range exceeding 250° C. and not higher than 350° C.

That is, the retained austenite in which iron nitride particles with a major axis length of several tens nm to several hundreds nm, especially 50 to 300 nm ($\epsilon$-$Fe_3N$ and/or $\zeta$-$Fe_2N$) are dispersed is transformed into deformation-induced martensite by "performing shot peening treatment after quenching" of item (i), and thereby the hardness is increased.

In the case where the member is heated to a temperature exceeding 350° C., the retained austenite is decomposed into ferrite, $Fe_3C$ and $\gamma'$-$Fe_4N$. Therefore, even if shot peening treatment is performed immediately after heating, it is ineffective to increase the hardness.

However, the retained austenite enhances the hardness of surface layer as described in the following paragraphs by "performing quenching, subsequently performing shot peening treatment while heating to a temperature not higher than 350° C. or immediately after heating to a temperature not higher than 350° C." in item (ii), or by "performing quenching, subsequently performing tempering in the temperature range exceeding 250° C. and not higher than 350° C., and performing shot peening treatment" in item (iii).

In the case where the temperature T° C. exceeds 250° C. and is not higher than 350° C. and the time period for which the member is held at that temperature is 1 hour or longer in the process of item (ii) in which heating is performed after quenching, phase decomposition caused by isothermal bainitic transformation occurs, and the retained austenite is transformed to fine bainitic ferrite with a width of about 50 to 200 nm and a length of about 200 nm to 1 μm, $Fe_3C$ and $\alpha''$-$Fe_{16}N_2$, and thereby the hardness is increased. Moreover, in the case, even if the isothermal bainitic transformation is still proceeding, and the retained austenite is not decomposed completely and some thereof remains, the isothermal bainitic transformation is accelerated by mechanical energy as far as shot peening treatment is performed while heating or immediately after heating. Therefore, a greater effect of increasing the hardness is achieved.

In the case where the temperature T° C. exceeds 250° C. and is not higher than 350° C. and the holding time is shorter than 1 hour in the process of item (ii), even if the isothermal bainitic transformation is still proceeding, and the retained austenite is not decomposed completely and some thereof remains, by performing shot peening treatment while heating or immediately after heating, the isothermal bainitic transformation is accelerated by mechanical energy. Therefore, the effect of increasing the hardness is achieved.

In the case where the temperature T° C. is lower than 250° C. in the process of item (ii), although decomposition caused by isothermal bainitic transformation scarcely occurs in the retained austenite, as in the case where shot peening treatment is performed after quenching in the process of item (i), the retained austenite is transformed into deformation-induced martensite by performing shot peening treatment, and therefore the effect of increasing the hardness is achieved.

In the case where the tempering temperature after quenching exceeds 250° C. and is not higher than 350° C. and moreover the time period for which the member is held at that temperature is 1 hour or longer in the process of item (iii), as described above, phase decomposition caused by isothermal bainitic transformation occurs, and the retained austenite is transformed to fine bainitic ferrite with a width of about 50 to 200 nm and a length of about 200 nm to 1 μm, $Fe_3C$ and $\alpha''$-$Fe_{16}N_2$, and thereby the hardness is increased. In this case as well, even if the retained austenite is not decomposed completely and some thereof remains after the finish of tempering, the remaining retained austenite is transformed into deformation-induced martensite by performing shot peening treatment after tempering, and thereby the hardness is further increased. In addition, the bainitic ferrite produced by isothermal bainitic transformation is also work hardened by shot peening treatment. Therefore, the hardness of surface layer increases further.

In the case where the temperature T° C. exceeds 250° C. and is not higher than 350° C. and the holding time is shorter than 1 hour in the process of item (iii), even if the isothermal bainitic transformation is still proceeding, and the retained austenite is not decomposed completely and some thereof remains, by performing shot peening treatment after tempering, the isothermal bainitic transformation is accelerated by mechanical energy. Therefore, the effect of increasing the hardness is achieved.

The $\epsilon$-$Fe_3N$ and $\zeta$-$Fe_2N$, which are iron nitride particles with a major axis length of several tens nm to several hundreds nm, existing from the time before shot peening in the process of item (i) are not changed by the shot peening treatment. The $\epsilon$-$Fe_3N$ and $\zeta$-$Fe_2N$, which are iron nitride particles with a major axis length of several tens nm to several hundreds nm, existing from the time before heating in the process of item (ii) and before tempering in the process of item (iii) are not changed likewise by the shot peening treatment. That is, the effect such that the own hardness which the iron nitride particles have is high and a so-called "dispersion strengthening" effect are not impaired at all by the shot peening treatment.

Therefore, by a synergetic effect of the action of the iron nitride particles and the increase in hardness caused by shot peening, or a synergetic effect of the two factors and the increase in hardness caused by phase decomposition resulting from isothermal bainitic transformation, the wear resistance and pitting strength of the carbonitrided member are improved greatly.

Moreover, a compressive residual stress introduced by shot peening treatment is effective in improving the bending fatigue strength. The reason for this is as described below. Among a martensitic structure produced in the quenching step, a ferritic structure produced by the isothermal bainitic transformation of retained austenite, and a martensitic structure produced by deformation-induced transformation from retained austenite, a structure existing in the surface layer is plastically deformed by the impact of shot-peened particles. As a result, elastic constraint occurs at the boundary with a region in which plastic deformation does not occur. Since the compressive residual stress has an inhibitory effect on the initiation and propagation of cracks in the fatigue process, the pitting strength and bending fatigue strength are improved.

In the case where after quenching, shot peening treatment is performed while heating to a temperature not higher than 350° C. or immediately after heating to a temperature not higher than 350° C. in the process of item (ii), the effect such that isothermal bainitic transformation is accelerated by mechanical energy and a so-called "ausforming" effect are sometimes achieved.

The ausforming is a technique that is well known in the field of a so-called "thermo-mechanically controlled process (TMCP)" of steel materials. This is a technique in which if supercooled austenite is worked at a relatively low temperature, and is subsequently cooled to form a bainitic structure, the structure is further refined, so that a steel material excellent in balance between strength and toughness can be obtained. If quenching is performed at an increased cooling rate, martensite is refined. The fine bainite and martensite produced by ausforming as described above are called ausformed bainite and ausformed martensite, respectively. In the present invention, since the member is once cooled to room temperature by quenching after carbonitriding and before shot peening, the technique is different from ausforming in which a steel material is worked in a cooling process. However, since the retained austenite is regarded as "supercooled austenite", the technique in which the retained austenite is worked can be called ausforming in a metallurgical sense. By performing shot peening treatment immediately after carbonitriding followed by quenching and heating to a temperature not higher than 350° C., an ausform-like effect can also be achieved additionally.

In the process of item (ii), the heating temperature before shot peening is started and the heating holding temperature after the start of shot peening need not be equal. For example, a member may be heated by being put in an electric furnace of 300° C. and be taken out of the furnace, and may be subjected to shot peening while being held isothermally on a hot plate adjusted at 250° C.

As a shot peening method, a publicly known shot peening method using an air nozzle or an impeller can be employed. Hereunder, one example of typical conditions of shot peening in the present invention is described.

Diameter of peening media (particle diameter of shot particle): 0.2 to 0.8 mm

Hardness of peening media: 600 to 800 in Vickers hardness scale

Peening air pressure: 0.1 to 0.5 MPa

Peening speed: 30 to 100 m/s

Coverage: 200 to 500%

Arc height: 0.4 to 0.6 mmA

For this reason, the producing conditions of the present invention were set so as to consist of any of the processes of items (i) to (iii) described above.

The sizes of iron nitrides of c-$Fe_3N$ and ζ-$Fe_2N$ can be checked, for example, by sampling a thin-film specimen and by observing it with a transmission electron microscope (hereinafter, referred to as a "TEM"). An electron diffraction pattern is photographed from a region including these iron nitrides, and the diffraction pattern is analyzed to determine the crystal structure and the lattice constant. Thereby, which is the iron nitride, ε-$Fe_3N$ or ζ-$Fe_2N$, can be identified.

Concerning the decomposition of retained austenite, the shape and size of phase can be checked, for example, by sampling a thin-film specimen and by observing it with a TEM. An electron diffraction pattern is photographed in a selected area including a specific phase, and the diffraction pattern is analyzed to identify each phase.

Hereunder, the present invention is explained in more detail with reference to examples.

The present inventor previously indicated, by the filing of Japanese Patent Application No. 2008-307250 in which "Carbonitrided member and method for producing the same" were proposed, that although the content of Mo, which is an expensive alloying element, is reduced, or Mo is not added, excellent wear resistance and high pitting strength can be ensured.

The method for producing the carbonitrided member in the application is specifically "a method for producing a carbonitrided member such that the raw steel material thereof contains, by mass percent, C: 0.10 to 0.35%, Si: 0.15 to 1.0%, Mn: 0.30 to 1.0%, Cr: 0.40 to 2.0%, and S: 0.05% or less, further containing Mo: 0.50% or less as necessary, the balance being Fe and impurities, wherein a member is subjected to carburizing treatment in which the member is held in a carburizing atmosphere of 900 to 950° C., and successively is subjected to carbonitriding treatment in which the member is held in a carbonitriding atmosphere with the temperature of 800 to 900° C. and the nitrogen potential of 0.2 to 0.6%; next, the member is subjected to quenching treatment; and additionally, the member is subjected to tempering treatment in the temperature range exceeding 250° C. and not higher than 350° C". The present inventor indicated that although the content of Mo, which is an expensive alloying element, is reduced, or Mo is not added, a carbonitrided member having an excellent wear resistance and a high pitting strength can be obtained by the above-mentioned producing method.

Accordingly, in examples described below, explanation is given by focusing on the improvement in bending fatigue strength, which is a feature of the present invention.

EXAMPLES

Steel 1 and steel 2 each having the chemical composition given in Table 1 were melted in vacuum furnace to prepare ingots 50 kg in weight.

Steel 1 is a steel in which the content of Cr is increased among the elements of the steel equivalent to SCr420 specified in JIS G4053 (2008). Steel 2 is a steel equivalent to SCM420 specified in JIS, in which Mo is added to SCr420. In both of the steels, the contents of Ni and Cu as impurities were 0.03% or less and 0.02% or less, respectively.

TABLE 1

| | Chemical composition (in mass %, balance: Fe and impurities) | | | | | | | |
|---|---|---|---|---|---|---|---|---|
| Steel | C | Si | Mn | P | S | Cr | Mo | Remarks |
| 1 | 0.24 | 0.20 | 0.86 | 0.015 | 0.015 | 1.80 | — | |
| 2 | 0.21 | 0.26 | 0.83 | 0.014 | 0.014 | 1.12 | 0.16 | steel equivalent to SCM420 |

The ingot obtained as described above was heated to 1250° C. and thereafter was hot forged so that the finish temperature was 1000° C. to form a round bar 35-mm in diameter. After the finish of hot forging, the round bar was allowed to cool in the air.

Next, the round bar 35-mm in diameter was subjected to normalizing treatment in which the round bar was heated to 925° C. and was held for 120 minutes, and thereafter was allowed to cool in the air, whereby a mixed structure of ferrite and pearlite was formed.

Figure 2:
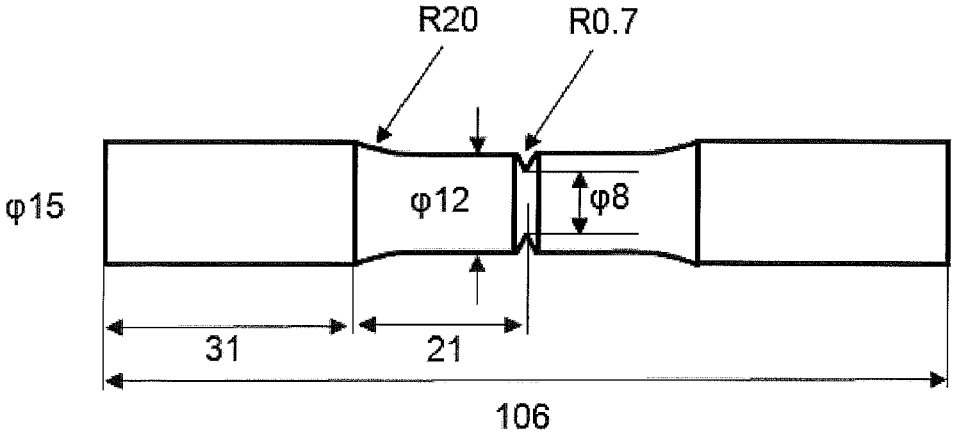
FIG. 2 is a diagram showing the shape of a test specimen used for the Ono type rotating bending fatigue test in examples. The unit of dimension is mm
Figure 3:
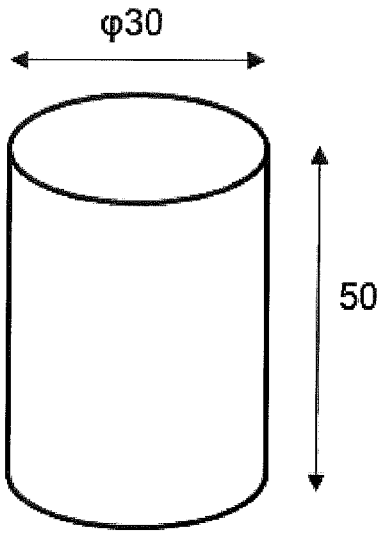
FIG. 3 is a diagram showing the shape of a test specimen for collecting chips, which is used for nitrogen concentration measurement in examples. The unit of dimension is mm.

From a central portion of the normalized round bar 35-mm in diameter, a test specimen for the Ono type rotating bending fatigue test having the shape shown in FIG. 2 and a test specimen for collecting chips having the shape shown in FIG. 3 were cut out in the direction parallel to the forging direction (forging axis).

Next, on each of the test specimens, "carburizing" treatment, "carbonitriding" treatment, and "oil quenching" treatment were performed under the conditions schematically shown in FIG. 1. On some of the test specimens for the Ono type rotating bending fatigue test, "tempering" treatment was performed under the conditions schematically shown in FIG. 1.

In the carburizing step, the temperature was 930° C., the holding time was 180 minutes, and the carbon potential was constant, being 0.8%.

In the carbonitriding step, the carbon potential was constant, being 0.8% as in the carburizing step, the holding time was also constant, being 90 minutes, and the holding temperature was 850° C. Nitriding was performed simultaneously with carburizing by mixing ammonia gas in the carburizing atmosphere.

The nitrogen potential was measured by using the test specimen for collecting chips that was oil quenched after carbonitriding. That is, the curved surface of the columnar specimen with a diameter of 30 mm and a height of 50 mm shown in FIG. 3 was lathe-turned from the outermost periphery toward the center direction by 50 μm, and the collected chips were analyzed by using an analyzer "Leco TC-136" based on the inert gas fusion principle using helium carrier gas and a thermal conductivity detector. As the result, the nitrogen concentration was determined 0.56%. That is, the nitrogen potential defined in the present invention was 0.56%.

The tempering step, which was a heating step, was carried out as described below.

The electric furnace were held at 200° C., 300° C. or 400° C. in advance, and some of the test specimens for the Ono type rotating bending fatigue test were inserted into the furnace.

A first group was held for 15 minutes after the furnace temperature had returned to the initial setting temperature, and thereafter was taken out of the heating furnace, and immediately a groove-form notch portion with a curvature of 0.7 mm in a central portion of the test specimen was subjected to shot peening treatment. Some test specimens were allowed to cool in the air without being subjected to shot peening treatment after being taken out of the furnace.

Another group was held for 60 minutes after the furnace temperature had returned to the initial setting temperature, and thereafter was taken out of the heating furnace, and was allowed to cool in the air. Subsequently, on the test specimen having the same temperature as the room temperature, a groove-form notch portion in a central portion was subjected to shot peening treatment at room temperature.

On some of the test specimens not subjected to tempering, a groove-form notch portion with a curvature of 0.7 mm in a central portion of the test specimen was subjected to shot peening treatment at room temperature as described above.

The conditions of the above shot peening treatment are as described below.

Apparatus: Direct pressure type shot peening apparatus

Peening media: Round cut wires (diameter: 0.6 mm, Vickers hardness: 800)

Peening air pressure: 0.4 MPa

Coverage: 300%

Arc height: 0.45 mmA

By using the test specimens for the Ono type rotating bending fatigue test, which were prepared as described above, the Ono type rotating bending fatigue test was conducted under the conditions: at the room temperature, in the atmosphere, and at a number of revolutions of 3400 rpm. The maximum stress such that the specimen does not rupture at a number of cycles of stress application of $10^7$ cycles was evaluated as a fatigue strength.

Some of the test specimens for the Ono type rotating bending fatigue test were not used for the Ono type rotating bending fatigue test, and were used to measure a hardness profile in the depth direction from the bottom of the groove-form notch with a curvature of 0.7 mm in the central portion of the test specimen to the central portion of the test specimen.

The hardness measurement was made by using a micro Vickers hardness tester on the 8-mm diameter cross section obtained by transversely cutting the test specimen in a cross-sectional manner at the groove-form notch portion with a curvature of 0.7 mm in the central portion of the test specimen.

Specifically, the surface was polished to mirror finish after being the specimen embedded in a resin so as to be a measured surface, and the hardnesses of depth positions of 30 μm, 50 μm and 100 μm from the surface were measured with a testing force of 2.94 N (300 gf) with the "bottom of the groove-form notch with a curvature of 0.7 mm" indicated in FIG. 2 being the top surface side. Subsequently, hardnesses were measured down to a depth position of 1 mm while proceeding at a 100 μm pitch in the depth direction, and further after that, hardnesses were measured down to a depth position of 2 mm while proceeding at a 200 μm pitch in the depth direction. Thereby, a hardness profile near the surface including the hardened layer was determined by connecting the discrete hardness values at the each position continuously. Hereinafter, the hardness at the depth position of 30 μm from the surface is referred to as a "surface layer hardness".

The test results of steel 1 and steel 2 are summarized in Table 2 and Table 3, respectively. "Hv" in Tables 2 and 3 means a Vickers hardness.

Figure 4:
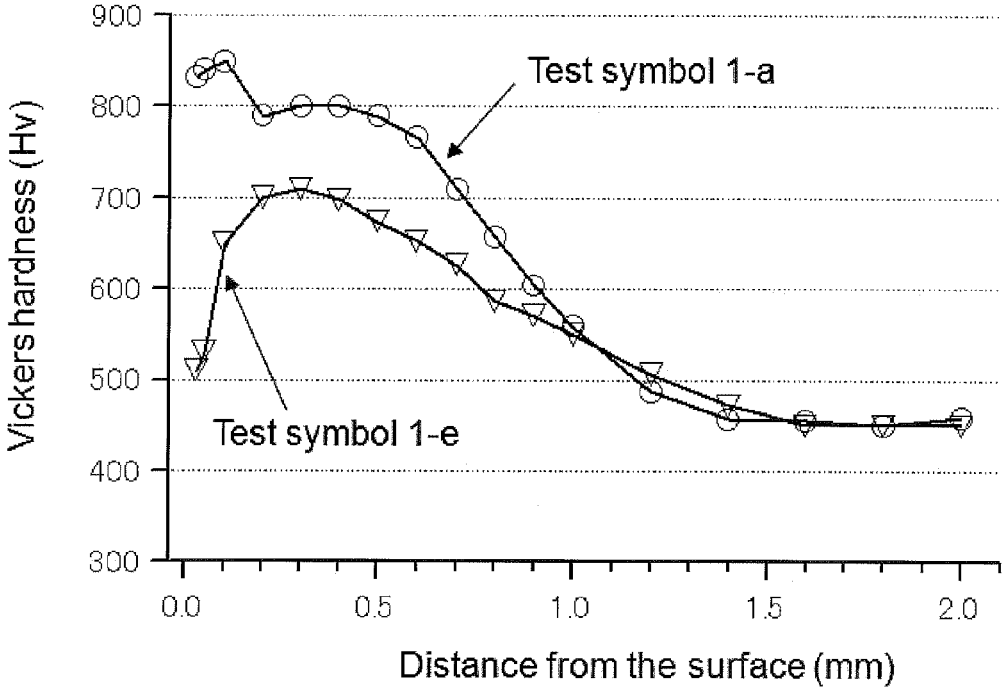
FIG. 4 is a graph showing a result of hardness measurement performed in examples, in which test symbols 1-a and 1-e in Table 2 are compared with each other.
Figure 5:
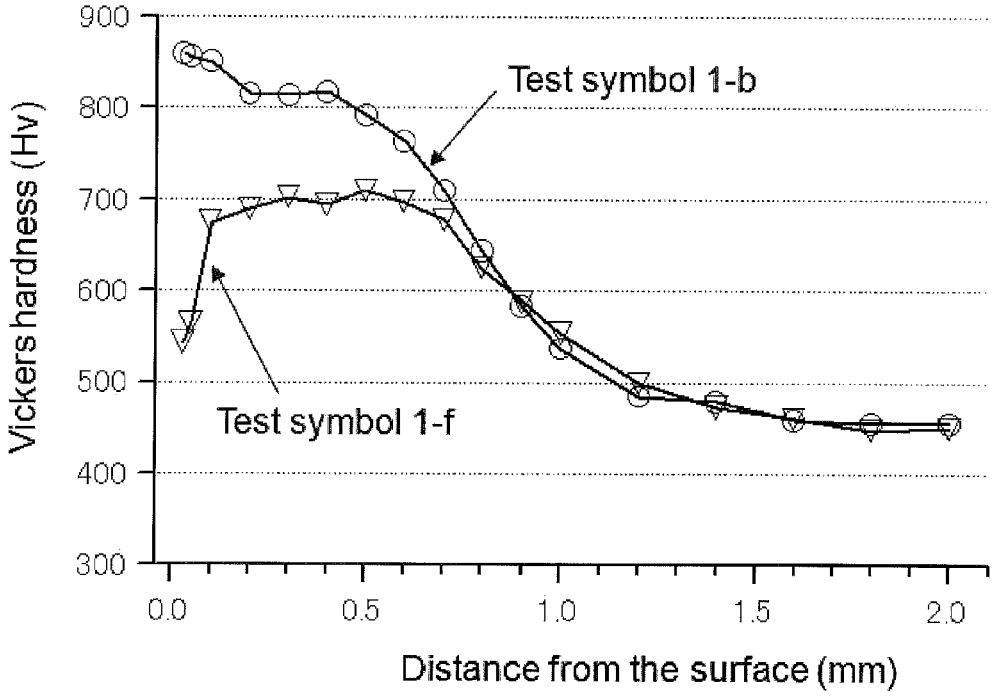
FIG. 5 is a graph showing a result of hardness measurement performed in examples, in which test symbols 1-b and 1-f in Table 2 are compared with each other.
Figure 6:
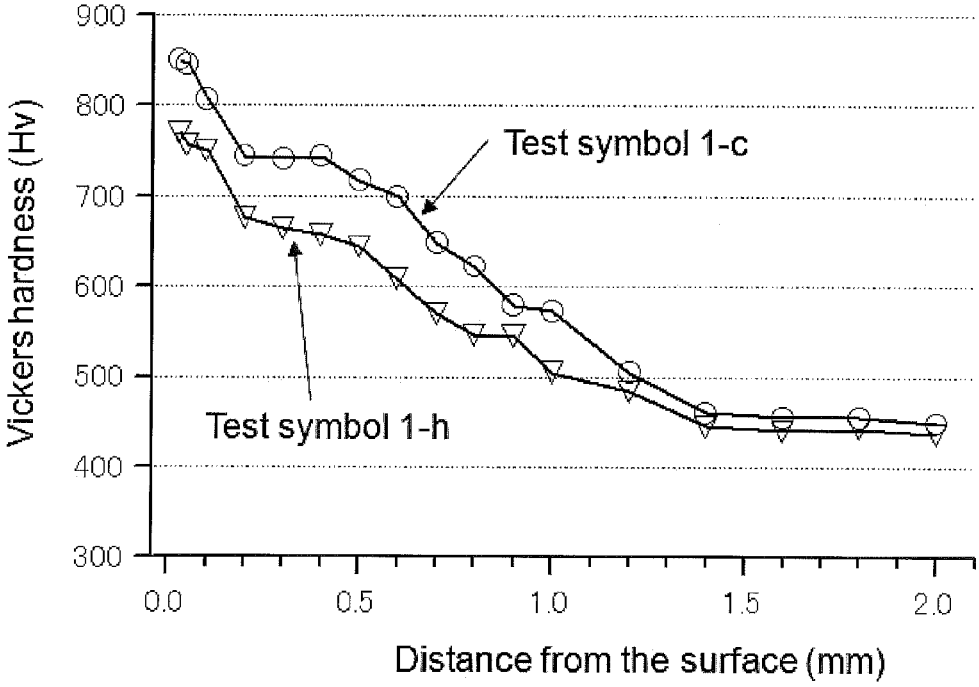
FIG. 6 is a graph showing a result of hardness measurement preformed in examples, in which test symbols 1-c and 1-h in Table 2 are compared with each other.

FIGS. 4 to 6 show hardness profiles of some test symbols for comparison.

TABLE 2

| Test symbol | Steel | Tempering Temp. (° C.) | Tempering Time (min) | Temperature of the test specimen when shot peening treatment is performed (° C.) | Surface layer hardness (Hv) | Rotating bending fatigue strength (MPa) | Remarks |
|---|---|---|---|---|---|---|---|
| 1-a | 1 | — | — | room temperature | 833 | 520 | Example of |
| 1-b | | 200 | 15 | 200 | 859 | 530 | the present |
| 1-c | | 300 | 15 | 300 | 850 | 520 | invention |
| 1-d | | 300 | 60 | room temperature | 862 | 530 | |
| 1-e | 1 | — | — | *— | 510 | 400 | Comparative |
| 1-f | | 200 | 15 | *— | 543 | 420 | example |

TABLE 2-continued

| Test symbol | Steel | Tempering Temp. (° C.) | Tempering Time (min) | Temperature of the test specimen when shot peening treatment is performed (° C.) | Surface layer hardness (Hv) | Rotating bending fatigue strength (MPa) | Remarks |
|---|---|---|---|---|---|---|---|
| 1-g | | 300 | 15 | *— | 550 | 420 | |
| 1-h | | *400 | 15 | 400 | 770 | 460 | |
| 1-i | | *400 | 60 | room temperature | 610 | 440 | |

*indicates that conditions do not satisfy those defined by the present invention.

"—" in the column of tempering indicates that tempering is not performed.

"—" in the column of Temperature of the test specimen when shot peening treatment is performed indicates that shot peening treatment is not performed.

TABLE 3

| Test symbol | Steel | Tempering Temp. (° C.) | Tempering Time (min) | Temperature of the test specimen when shot peening treatment is performed (° C.) | Surface layer hardness (Hv) | Rotating bending fatigue strength (MPa) | Remarks |
|---|---|---|---|---|---|---|---|
| 2-a | 2 | — | — | room temperature | 835 | 525 | Example of |
| 2-b | | 200 | 15 | 200 | 860 | 530 | the present |
| 2-c | | 300 | 15 | 300 | 860 | 530 | invention |
| 2-d | | 300 | 60 | room temperature | 865 | 535 | |
| 2-e | 2 | — | — | *— | 515 | 415 | Comparative |
| 2-f | | 200 | 15 | *— | 520 | 420 | example |
| 2-g | | 300 | 15 | *— | 540 | 425 | |
| 2-h | | *400 | 15 | 400 | 772 | 465 | |
| 2-i | | *400 | 60 | room temperature | 625 | 445 | |

*indicates that conditions do not satisfy those defined by the present invention.

"—" in the column of tempering indicates that tempering is not performed.

"—" in the column of Temperature of the test specimen when shot peening treatment is performed indicates that shot peening treatment is not performed.

Table 2 gives the test results in the case where steel 1, which is a steel equivalent to SCr420 specified in JIS except to the increased amount of Cr contained, is used. In Table 2, test symbols 1-a to 1-d are example embodiments of the present invention.

By performing shot peening after carbonitriding quenching, or by performing shot peening immediately after tempering is performed at 200° C. or 300° C. after carbonitriding quenching, the surface layer hardness results in a high value of 800 or higher in Vickers hardness scale, and the rotating bending fatigue strength also results in a high value of 500 MPa or higher.

In contrast, in comparative examples of test symbols 1-e to 1-h, the test results show that the surface layer hardness is low, and the rotating bending fatigue strength is inferior.

Table 3 gives the test results in the case where steel 2, which is a steel equivalent to SCM420 specified in JIS, is used. In Table 3, test symbols 2-a to 2-d are example embodiments of the present invention.

By performing shot peening after carbonitriding quenching, or by performing shot peening immediately after tempering is performed at 200° C. or 300° C. after carbonitriding quenching, the surface layer hardness results in a high value of 800 or higher in Vickers hardness scale, and the rotating bending fatigue strength also results in a high value of 500 MPa or higher.

In contrast, in comparative examples of test symbols 2-e to 2-h, the test results show that the surface layer hardness is low, and the rotating bending fatigue strength is inferior.

For test symbols 1-d and 2-d, shot peening treatment was performed after tempering at 300° C. for 60 minutes. In the tempering at 300° C. for 60 minutes, the retained austenite in the surface layer is sufficiently decomposed by isothermal bainitic transformation, and therefore the hardness of the surface layer increased. Since the shot peening was performed at room temperature after becoming such a state, the surface layer hardness increased further, and the rotating bending fatigue strength also took a high value exceeding 500 MPa.

In contrast, for test symbols 1-i and 2-i, shot peening treatment was performed after tempering at 400° C. for 60 minutes. In the tempering at 400° C. for 60 minutes, the retained austenite in the surface layer is decomposed into ferrite, cementite, and a rod-shaped coarse $\gamma'$-$Fe_4N$ nitride, and therefore the hardness of the surface layer did not increase. Even if shot peening is performed at room temperature after becoming such a state, the hardness of surface layer increases very slightly. Therefore, the rotating bending fatigue strength also took a low value lower than 500 MPa.

FIG. 4 compares the hardness profile of test symbol 1-a with that of test symbol 1-e. Neither of the test specimens was tempered. For test symbol 1-a which is subjected to shot peening treatment, the hardness around the surface to a depth of about 1 mm interior increases, and in particular, the hardness of the surface layer down to a depth of 100 μm increases remarkably.

FIG. 5 compares the hardness profile of test symbol 1-b with that of test symbol 1-f. Both of the test specimens were tempered at 200° C. for 15 minutes. For test symbol 1-b subjected further to shot peening treatment, the hardness around the surface to a depth of about 0.7 mm interior increases, and in particular, the hardness of the surface layer down to a depth of 100 μm increases remarkably as compared with test symbol 1-f that is merely tempered and is not subjected to shot peening.

Comparing the hardness profile of test symbol 1-b with the hardness profile of test symbol 1-a shown in FIG. 4, it is found that the hardness of the surface layer down to a depth of 100 μM increases by several tens in Vickers hardness scale. This indicates that some of retained austenite was subjected to isothermal bainitic transformation by the holding at 200° C. for 15 minutes, and thereby the hardness was increased. Further, the additional effect of shot peening treatment raised the hardness profile to the level shown in test symbol 1-b.

FIG. 6 compares the hardness profile of test symbol 1-c with that of test symbol 1-h. Both of the test specimens were subjected to shot peening. For test symbol 1-h (subjected to shot peening immediately after tempering at 400° C. for 15 minutes), the hardness of the surface layer down to a depth of 100 μm is low and does not exceed 800 in Vickers hardness scale as compared with test symbol 1-c (subjected to shot peening immediately after tempering at 300° C. for 15 minutes). This indicates that because the tempering temperature before shot peening and the temperature at which shot peening was performed were too high, the retained austenite was not transformed into bainite, rather was decomposed into ferrite and cementite, or even if the retained austenite having been changed to deformation-induced martensite, it was immediately decomposed into ferrite and cementite because of its high temperature, and therefore, the hardness was hardly increased.

Seeing the results given in Table 2 based on the results shown in FIGS. 4 to 6, it is apparent that the test specimen whose surface layer hardness is increased by shot peening has a high rotating bending fatigue strength, and is effective in improving the fatigue strength.

Although only some exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention.

Industrial Applicability

According to the method for producing a carbonitrided member of the present invention, although an inexpensive steel, in which the content of Mo that is an expensive alloying element is low or Mo is not added, is used as a starting material, a carbonitrided member having excellent wear resistance, high pitting strength, and excellent bending fatigue strength can be obtained. Therefore, the carbonitrided member obtained by the method for producing a carbonitrided member in accordance with the present invention can be used as a power transmitting part, such as a gear for an automotive transmission and a pulley for a belt-type continuously variable transmission, that is required to have a smaller size and a higher strength to realize a reduction in weight of vehicle body which directly leads to the improvement in fuel economy. In addition, the carbonitrided member can also realize a reduction in producing cost as compared with the conventional power transmitting part.

What is claimed is:

1. A method for producing a carbonitrided member comprising the steps of:

carburizing a steel part having a composition of, by mass percent, C: 0.10 to 0.35%, Si: 0.15 to 1.0%, Mn: 0.30 to 1.0%, Cr: 0.40 to 2.0%, S: 0.05% or less with the balance being Fe and impurities in a carburizing atmosphere at a temperature of 900 to 950° C.;

then, while maintaining the carburizing atmosphere, carbonitriding the steel part immediately following the carburizing by holding the carburized steel part in a temperature of 800 -900C. in a carbonitriding atmosphere having a nitrogen potential of 0.2 to 0.6%;

quenching the carbonitrided steel part; and shot peening the quenched steel part while heating to a temperature not higher than 350° C. or immediately after heating to a temperature not higher than 350° C., wherein the carburizing atmosphere is maintained with a constant carbon potential throughout carburizing and carbonitriding and up to quenching.

2. A method for producing a carbonitrided member comprising the steps of:

carburizing a steel part having a composition of, by mass percent, C: 0.10 to 0.35%, Si: 0.15 to 1.0%, Mn: 0.30 to 1.0%, Cr: 0.40 to 2.0%, S: 0.05% or less with the balance being Fe and impurities in a carburizing atmosphere at a temperature of 900 to 950° C., then, while maintaining the carburizing atmosphere, carbonitriding the steel part immediately following the carburizing by holding the carburized steel part at a temperature of 800-900 C in a carbonitriding atmosphere having a nitrogen potential of 0.2 to 0.6%;

quenching the carbonitrided steel part; and tempering the quenched steel part in the temperature range exceeding 250° C. and not higher than 350° C. and then shot peening the tempered steel part, wherein the carburizing atmosphere is maintained with a constant carbon potential throughout carburizing and carbonitriding and up to quenching.

3. The method for producing a carbonitrided member according to claim 1, wherein the composition of the steel part further contains Mo: 0.50% or less by mass percent in lieu of a part of Fe.

4. The method for producing a carbonitrided member according to claim 2, wherein the composition of the steel part further contains Mo: 0.50% or less by mass percent in lieu of a part of Fe.

* * * * *

UNITED STATES PATENT AND TRADEMARK OFFICE

CERTIFICATE OF CORRECTION

PATENT NO. : 9,062,364 B2
APPLICATION NO. : 13/415198
DATED : June 23, 2015
INVENTOR(S) : Naoyuki Sano et al.

It is certified that error appears in the above-identified patent and that said Letters Patent is hereby corrected as shown below:

Title Page, item (57) in the Abstract:

Line 9:
steel part is qhenched and then shot peened. The shot peening
should read
steel part is quenched and then shot peened. The shot peening Signed and Sealed this
Twenty-sixth Day of April, 2016

Michelle K. Lee

Michelle K. Lee
*Director of the United States Patent and Trademark Office*